US010395791B2

(12) United States Patent
Gordon et al.

(10) Patent No.: US 10,395,791 B2
(45) Date of Patent: Aug. 27, 2019

(54) ELECTRICALLY CONDUCTIVE NANOWIRE LITZ BRAIDS

(71) Applicants: President and Fellows of Harvard College, Cambridge, MA (US); The Charles Stark Draper Laboratory, Inc., Cambridge, MA (US)

(72) Inventors: Roy Gerald Gordon, Cambridge, MA (US); Amy Elizabeth Duwel, Cambridge, MA (US)

(73) Assignees: President and Fellows of Harvard College, Cambridge, MA (US); The Charles Stark Draper Laboratory, Inc., Cambridge, MA (US)

( * ) Notice: Subject to any disclaimer, the term of this patent is extended or adjusted under 35 U.S.C. 154(b) by 0 days.

(21) Appl. No.: 15/755,376

(22) PCT Filed: Aug. 26, 2016

(86) PCT No.: PCT/US2016/049010
§ 371 (c)(1),
(2) Date: Feb. 26, 2018

(87) PCT Pub. No.: WO2017/040292
PCT Pub. Date: Mar. 9, 2017

(65) Prior Publication Data

US 2018/0254117 A1 Sep. 6, 2018

Related U.S. Application Data

(60) Provisional application No. 62/211,515, filed on Aug. 28, 2015.

(51) Int. Cl.
*H01B 1/02* (2006.01)

(52) U.S. Cl.
CPC ..... *H01B 1/023* (2013.01); *H01B 1/026* (2013.01)

(58) Field of Classification Search
CPC ..... H01B 1/023; H01B 1/026
(Continued)

(56) References Cited

U.S. PATENT DOCUMENTS 1,987,442 A * 1/1935 Harris ..... H01B 11/002 174/110 SY
3,193,712 A * 7/1965 Harris ..... H01B 9/04 174/105 R (Continued)

OTHER PUBLICATIONS

Au, Y., et al., "Filling Narrow Trenches by Iodine-Catalyzed CVD of Copper and Manganese on Mangnese Nitride Barrier/Adhesion Layers," Journal of Electrochemical Society, vol. 158, Issue 5, pp. D248-D253 (Mar. 17, 2011).

(Continued)

*Primary Examiner* — Andargie M Aychillhum
*Assistant Examiner* — Michael F McAllister
(74) *Attorney, Agent, or Firm* — Wilmer Cutler Pickering Hale and Dorr LLP

(57) ABSTRACT

A structure includes a high-strength nanowire core with a first electrically-conductive metal layer bonded to an outer surface thereof. An insulating layer is bonded to an outer surface of the first electrically-conductive metal layer, and a second electrically-conductive metal layer is bonded to an outer surface of the insulating layer. The nanowires are braided into a litz bundle, which reduces electrical losses during transmission of high-frequency current.

17 Claims, 4 Drawing Sheets

(58) Field of Classification Search
USPC ..... 174/126.2
See application file for complete search history.

(56) References Cited

U.S. PATENT DOCUMENTS

| | | | | |
|---|---|---|---|---|
| 3,309,455 | A * | 3/1967 | Mildner | H01B 11/1826 156/54 |
| 3,954,572 | A * | 5/1976 | Ziegler | H01L 39/2409 205/51 |
| 6,326,551 | B1 * | 12/2001 | Adams | H01B 11/1804 174/113 C |
| 8,044,139 | B2 * | 10/2011 | Youn | C08L 77/06 524/492 |
| 8,723,043 | B2 * | 5/2014 | Weiss | H01B 1/22 174/117 M |
| 2003/0230427 | A1 * | 12/2003 | Gareis | H01B 11/04 174/113 C |
| 2008/0047733 | A1 * | 2/2008 | Axakov | H05B 3/56 174/110 R |
| 2008/0290080 | A1 * | 11/2008 | Weiss | H05B 1/0238 219/202 |
| 2009/0143524 | A1 * | 6/2009 | Nakayama | C08J 5/042 524/450 |
| 2009/0196982 | A1 | 8/2009 | Jiang et al. | |
| 2009/0295531 | A1 * | 12/2009 | Silva | H01F 3/10 336/221 |
| 2011/0204297 | A1 | 8/2011 | Park et al. | |
| 2012/0073859 | A1 * | 3/2012 | Lo | H01L 24/43 174/126.4 |
| 2013/0109986 | A1 | 5/2013 | Liu et al. | |
| 2013/0240241 | A1 | 9/2013 | Dubrow et al. | |
| 2016/0064117 | A1 * | 3/2016 | Romero | H01B 1/026 600/16 |
| 2016/0148725 | A1 * | 5/2016 | Flory | G02B 6/4434 174/107 |
| 2016/0189827 | A1 * | 6/2016 | Gao | H01B 1/026 174/124 R |

OTHER PUBLICATIONS

Chen, F., et al., "Mechanical characterization of single high-strength electrospun polyimide nanofibres," Journal of Physics D: Applied Physics, vol. 41, No. 025308, pp. 1-8 (Jan. 4, 2008).

Geltmeyer, J., et al., "Optimum sol viscosity for stable electrospinning of silica nanofibres," Journal of Sol-Gel Science and Technology, vol. 67, Issue 1, pp. 188-195 (Jul. 2013).

Hausmann, D., et al., "Rapid Vapor Deposition of Highly Conformal Silica Nanolaminates," Science, vol. 298, Issue 5592, pp. 402-406 (Oct. 11, 2002).

International Search Report issued by the U.S. Patent and Trademark Office as International Searching Authority for International Application No. PCT/US2016/049010 dated Nov. 16, 2016 (3 pages).

Li, D., et al., "Electrospinning of Polymeric and Ceramic Nanofibers as Uniaxially Aligned Arrays," Nano Letters, vol. 3, No. 8, pp. 1167-1171 (Jun. 20, 2003).

Zhang, H., et al., "Heat-resistant polybenzoxazole nanofibers made by electrospinning," European Polymer Journal, vol. 50, pp. 61-68 (Jan. 2014).

* cited by examiner

ELECTRICALLY CONDUCTIVE NANOWIRE LITZ BRAIDS

RELATED APPLICATIONS

This application is a U.S. National Stage application under 35 U.S.C. § 371 of International Patent Application No. PCT/US2016/049010, filed Aug. 26, 2016, which claims the benefit and priority of the filing date of U.S. Provisional Patent Application No. 62/211,515, filed Aug. 28, 2015, the contents of which are hereby incorporated by reference in their entirety.

BACKGROUND

One structure made out of conductive wires is called a litz "wire," which is actually a braided bundle of multiple individual wires. Litz bundles have been used for nearly a century to reduce electrical losses during the transmission of alternating current at frequencies below the megahertz (MHz) range. The word "litz" is derived from the German word "Litzendraht," meaning woven wire. It refers to wire that includes a plurality of individually-insulated wires that have been twisted or braided into a uniform pattern, so that along the braided cable each strand moves in and out through all possible positions in the cross-section of the entire cable. This multi-strand configuration, or litz wire, is designed to minimize power losses that can be exhibited in solid conductors as a result of the "skin effect." Skin effect refers to the tendency of alternating current flow in a conductor to be confined to a layer in the conductor close to its outer surface. At low frequencies, the skin effect is negligible, and current is distributed uniformly across/throughout the conductor. However, as the frequency increases, the depth to which the current flow can penetrate below the surface of the conductor is reduced. Litz wire constructions counteract this effect by reducing the diameter of the individual wires, thereby increasing the amount of surface area without significantly increasing the overall size (e.g., diameter) of the bundle.

SUMMARY

Materials and techniques are disclosed that provide very small electrically conductive composite nanowires and microwires that are also strong, smooth, insulated and flexible enough to be formed into litz bundles with low electrical loss at high frequencies. The diameters of the wires can be in the range from a few nanometers (nm) to a few micrometers (μm), typically from about 100 nm (0.1 μm) to about 1 μm. In certain embodiments, the composite wire has a diameter of less than 10 micrometers. In other embodiments, the composite wire has a diameter of less than 2 micrometers. In still other embodiments, the composite wire has a diameter of less than 0.5 micrometers. The nanowire cross sections have a shape, for example round/circular, and can be smooth and asperity-free.

The composite nanowire can include a high strength core or "scaffold." A very strong polymer, such as a polyarylamide, is preferred to facilitate handling the nanowires without breakage. Arylamide polymers, such as poly-meta-arylamide (Nomex™) or poly-para-arylamide (Kevlar™ or Twaron™), and polybenzoxazole (Zylon™) are preferred. High-strength carbon fibers or silica can also be used as the scaffold or core. These high-strength cores give the wires sufficient strength to allow conventional techniques to be used to weave the nanowires into litz braids. The core diameter is generally a fraction, such as 0.1 to 0.3, of the total diameter of the nanowire.

In some embodiments, a structure includes an electrically conductive metal layer coating that surrounds (i.e., bonded to an outer surface of) the nanocore. Any metal or metal alloy can be used as the conductive metal coating. Copper and aluminum are the preferred electrically conductive metals. The coating thickness can be at least slightly larger than the skin depth of alternating current at the frequency of the current, for example, 20% larger, 50% larger or 100% larger. In some embodiments, an insulating layer is bonded to an outer surface of the electrically conductive metal layer.

In some embodiments, a structure includes a high strength nanowire core. A first electrically conductive metal layer is bonded to an outer surface of the high-strength nanowire core. An insulating layer is bonded to an outer surface of the first electrically conductive metal layer, and a second electrically conductive metal layer is bonded to an outer surface of the insulating layer. The second electrically conductive metal layer can be the same or different from the first electrically conductive metal layer. The structure can have a diameter of less than 10 micrometers, less than 2 micrometers, or less than 0.5 micrometers. The high strength nanowire core can comprise a high-strength polymer, such as polyarylamide.

In some implementations, structures described herein can be incorporated into a litz braid, an antenna, or an electronic circuit.

In some embodiments, the nanowire core comprises a carbon nanofiber or a silica fiber.

In some embodiments, the metal comprises copper, aluminum or a copper manganese alloy.

In some embodiments, the insulator comprises a metal oxide, silica or a metal silicate.

The nanowires can also be provided with a very thin electrically insulating coating, which helps to reduce magnetic and electrical field interactions between wires. The outer insulation layer can be an insulating polymer or a metal oxide such as silica. The insulator layer thickness is sufficiently large to prevent breakdown by the electric fields that the insulator may encounter during operation.

In one or more embodiments, for example, where high frequency performance is desired, the composite nanowire further includes a conductive layer over the insulating layer. A conductive metal layer can be applied to reduce or eliminate capacitive coupling between neighboring nanowires. This outer cylinder of metal converts each nanowire into a nano-coaxial cable. The RF electric field from one nanowire is thus prevented from inducing current in neighboring nanowires. With this structure, the RF currents are guided to stay within each nano-coaxial cable in the correct independent pathways that move the same way low-frequency current travels in existing low-frequency litz bundles.

These electrically conducting, insulated, smooth, strong and flexible nanowires are suitable for being braided into nano-litz bundles that can function as inductors with exceptionally low electrical losses when operating at high frequencies in the RF range. Dozens or hundreds of nanowires can be braided into a single high-performance nano-litz bundle.

A method for fabricating these nanowires is also provided. The method starts with suitable nanowires as a scaffold or core onto which the metallic conductor is deposited and bonded. In certain embodiments, the core can be a spun, e.g., an electrospun, wire or fiber of extremely narrow dimension. Spun wires can be made in any desired length, ranging from less than 1 cm to over 1 kilometer. The availability of long lengths of core wire or fiber allows for the facile production of composite wires of any length desired.

Next, a conductive metal is deposited on the core. Any metal or metal alloy capable of deposition over a substrate can be used in the manufacture of the composite nanowire. The metals can be deposited on the nanowire scaffold by any convenient method that results in a round, smooth, strongly adherent metal coating. Vapor deposition techniques, such as chemical vapor deposition (CVD) are well-suited to form the metal layers with appropriate structure. In the case of CVD copper, the smoothness of the surface and adhesion to the nanowire substrate can be enhanced by co-deposition of a small percentage of manganese along with the copper. The smoothness of CVD copper coatings can also be enhanced using iodine as a catalyst on the growing surface of the copper. Physical vapor deposition (PVD) methods, such as evaporation or sputtering, can also be used to coat metal onto the polymer nanowire, but care must be taken to ensure uniform thickness is deposited on all sides of the nanowire. Electrochemical deposition can be used to thicken a copper layer once a thin, electrically-conductive seed layer has been deposited by CVD or PVD.

In a third step, an insulating layer is deposited over and around the conductive metal. The adherent, insulating layer can be produced conveniently by CVD or other vapor deposition techniques such as atomic layer deposition (ALD), by vacuum deposition (PVD techniques, such as evaporation or sputtering), by solution deposition or by electrochemical polymerization. The insulating material should have as low a dielectric constant as possible, in order to minimize the capacitance between the nanowires.

In a fourth step, if desired, a final adherent metal layer is deposited on top of the insulating layer. The materials and methods for making this final metal layer may be the same as those used to form the inner conductive metal layer. Alternatively, different methods may be employed for the two metal layers.

In some embodiments, a method of making a composite nanowire includes providing a length of a fiber core with a diameter of less than 3 μm. A conductive metal is deposited (e.g., by vapor deposition or chemical deposition) over the length of fiber core, and an insulating layer is deposited (e.g., by vapor deposition or chemical deposition) over the conductive metal. The composite nanowire can have a diameter of less than 10 micrometers. The fiber core can comprise an electrospun fiber. Alternatively or in addition, the fiber core can include one or more of: polyacrylamide, carbon and silica. A second conductive metal layer can be deposited over the insulating layer. The nanocomposite wire can be annealed to bond the fiber core, conductive metal and insulating layers.

The optimal braid structure is not a simple twist but alters the pattern so that each wire takes a turn near the center of the bundle. In that way, the fringing magnetic fields from the nanowires almost completely cancel each other in the regions external to the braided wire.

Current approaches to wire braiding leverage macro-scale machines that impose tension and bending forces that would break nano-to-micron-scale metal wires during braiding. The wire structure according to the present invention overcomes this problem by embedding high-strength polymer cores into the centers of the nanowires. For example, Kevlar is 15 times stronger than steel and 82 times stronger than copper.

New technologies can also be used to braid the nanowires. In a "Directed Assembly" approach, the wire ends are attached to dielectric or metallic beads with magnetic cores, so that a programmable electrode array can manipulate the beads and in turn braid the wires. This method is described in U.S. Application Ser. No. 62/211,134, entitled "Directed Assembly of Nano-Wires", filed on even date herewith and which is incorporated in its entirety by reference.

These and other aspects and embodiments of the disclosure are illustrated and described below.

BRIEF DESCRIPTION OF THE DRAWINGS

The invention is described with reference to the following figures, which are presented for the purpose of illustration only and are not intended to be limiting.

In the Drawings.

DETAILED DESCRIPTION

Figure 1A:
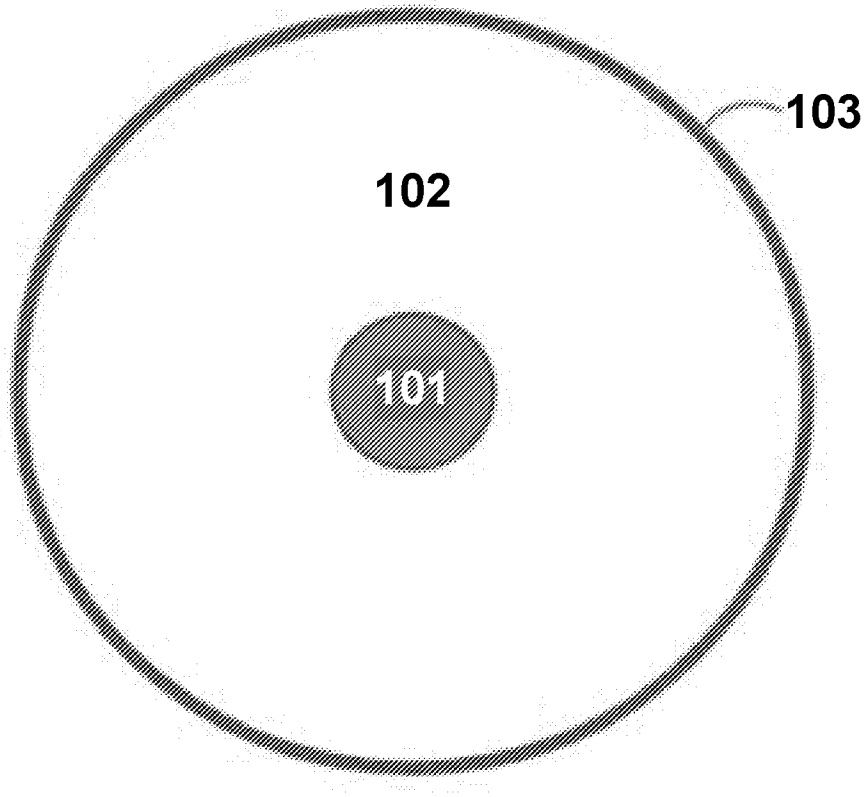
FIG. 1A is a schematic cross section of a nanowire structured in accordance with one or more embodiments.

Litz bundles, described above as being advantageous for minimizing the impact of the "skin effect," have the potential to significantly reduce electrical losses in circuits that operate at frequencies above 1 megahertz (MHz) or 1 gigahertz (GHz). However, no technology has previously been available to make litz bundles that operate efficiently at MHz or GHz frequencies. Collectively, MHz and GHz frequencies will be referred to herein as radio frequencies (RF). The individual wires in a hypothetical nano-litz bundle should have diameters in the nanometer (nm) to micrometer (μm) range, so that their thickness is comparable to the skin depth of current at the frequency of the current. They should also be strong, round, smooth and flexible, and be covered by a thin insulating layer. Previous processes for making conducting wires do not scale well to the sizes needed for RF, such as the range of 0.6 μm-2 μm diameter wires for frequencies from 1 GHz up to 10 GHz. Metal wires with such small diameters are too fragile to braid easily into the appropriate patterns by any known method.

There is a second reason that litz wires are not presently available for the RF frequency range. As the size of the individual wires is scaled down, the capacitance between neighboring wires in the bundle increases. This capacitive coupling means that current flowing in one wire induces current in neighboring wires. Thus, RF current in a bundle does not simply move independently down each wire, as the theory of litz bundles requires. In effect, the insulation between neighboring wires becomes leaky at RF frequencies.

Using nano-litz braiding technologies described herein, inductors with high quality factors, approaching Q=1000 at 1-10 GHz, can be produced. The RF industry can immediately benefit from such technology, with low loss components providing better filters to address spectral crowding and jamming, as well as improved power handling for thermally robust, portable and miniature systems. In addition to inductors, numerous other RF components and systems can benefit from lower conductor losses, including RF matching networks, transmitting equipment and antennas.

Nano-Wire Fabrication

In some embodiments, the first step is to provide thin support nanowires on which copper and then an insulator are deposited. Support nanowires about 0.3 microns in diameter are suspended between solid supports using an electrospinning technique (*Nano Lett.* 3, 1167 (2003)). Both silica (*J. Sol-Gel Sci. Technol.* 67, 188 (2013)) and polyimide (*J. Phys. D* 41, 025308 (2008)) are examples of useful materials for the support nanowires. Electrospray can produce these nanowires at high speeds, for example on the order of about $10^4$ cm/sec.

The core polymer scaffold for the nanowires can be made by electrospinning of a solution of the polymer in a suitable solvent. Poly-meta-arylamides (such as Nomex™, made by DuPont), poly-para-arylamides (such as Kevlar™, made by DuPont and Twaron™, made by Teijin) and polybenzoxazole (Zylon™, made by Toyoba) are particularly suitable because of their high strength and high thermal stability. Arylamide polymer fibers can be spun from solutions in solvents such as N,N-dimethylacetamide (DMA), N,N-dimethylformamide (DMF), N-methyl-2-pyrrolidinone (NMP) or dimethylsulfoxide (DMSO). Salts such as lithium chloride can be used to enhance the solubility and/or conductivity of the electrospinning solutions. Co-polymers of meta-arylamide and para-arylamide are particularly preferred because of their enhanced solubility. Polybenzoxazole (PBO) can be electrospun from solution in a mixture of trifluoroacetic acid and methanesulfonic acid. PBO nanofibers can also be made by electrospinning a more soluble pre-polymer, and then heating it to convert it into PBO. First, a low-temperature polycondensation reaction is used to synthesize the precursor of PBO, a hydroxy-containing polyamic acid (OH-PAA), from 3,30,4,40-biphenyltetracarboxylic dianhydride (BPDA) and 3,30-dihydroxybenzidine (DHB). Then, electrospinning of an OH-PAA solution in a mixture of DMA and dichloromethane with its conductivity enhanced by cetyltrimethylammonium bromide (CTAB, 0.1 wt % to OH-PAA) forms nanofibers that can then be heated to convert the OH-PAA polymer into PBO nanofibers. (*European Polymer Journal* 50, 61 (2014)).

Next, chemical vapor deposition of a copper-manganese alloy can be used to coat the nanowire conformally at a temperature of about 200° C. (*J. Electrochem. Soc.* 158, D248 (2011)). Then, atomic layer deposition is used to form a thin layer of alumina-doped silica at a temperature of about 250° C. (*Science* 298, 402 (2002)). Finally, an anneal at about 350° C. is used to diffuse manganese out of the copper into its interfaces with silica and/or polyimide. In some embodiments, the purpose of the manganese is to stabilize the copper and bond it strongly to the interfaces with the substrate nanowire and the outside silica insulation. In addition, the manganese can create an impervious barrier preventing diffusion of copper into the silica layers, and/or protect the copper from oxidation by water or oxygen diffusing from outside.

A schematic cross section of a nanowire, according to some embodiments, is shown in FIG. 1A. The core, or support nanowire, is indicated by 101. The surrounding metal layer 102 is bonded to the core. An insulating layer 103 is bonded to the metal layer.

Figure 1B:
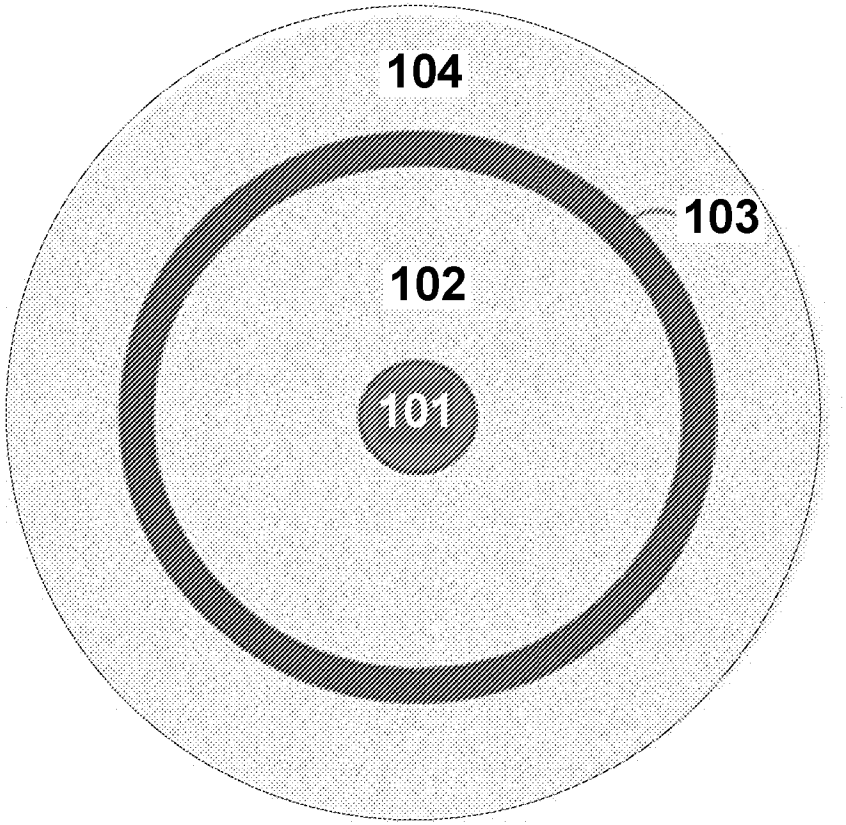
FIG. 1B is a schematic cross section of a nanowire structured in accordance with one or more embodiments.

A schematic cross section of such a nanowire according to another embodiment is shown in FIG. 1B. The core or support nanowire is indicated by 101. The surrounding metal layer 102 is bonded to the core. An insulating layer 103 is bonded to the metal layer 102. A second metal layer 104 is bonded to the outside of the insulating layer 103.

Figure 2:
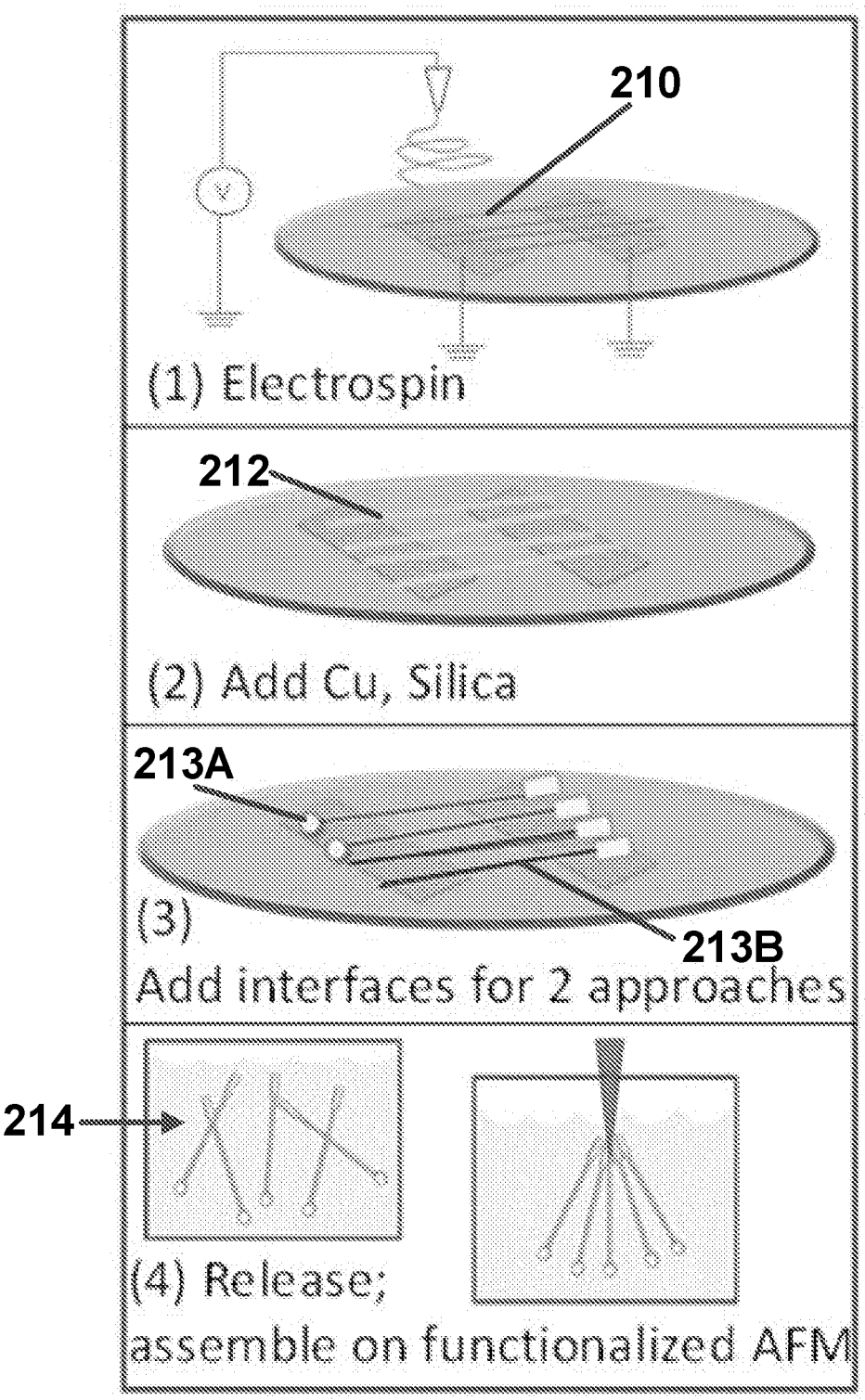
FIG. 2 shows how the nanowires of FIG. 1A or 1B can be spun, coated and braided into a nano-litz cable, according to some embodiments.

FIG. 2 shows a process sequence including the addition of interfaces for each braiding approach, according to some embodiments. The process sequence for generating spun wires 210 (steps (1) and (2)), adding interfaces (step (3)) such as coatings 212, and releasing and assembling bundles 214 ready to braid (step (4)). Step (3) shows that the interface for directed assembly can be a bead (213A) at the end, and the interface for self-assembly can be a metal trace (213B) down the wire length.

3D Nano-Litz Braids

In some embodiments, braided bundles of wires contain as many threads as the RF system can physically support, in terms of the bundle's cross-sectional thickness, since more current carrying capacity translates into lower loss. A game-changer for RF systems would be an L=10 nH inductor with a quality factor reaching 1000 at 5 GHz. This could be enabled by an inductor comprised of a braid with l=1 cm length $[L\sim(\mu_0\, l/2\pi)\cdot(\ln(8l/2\pi d)-2)]$, with N~675 individual threads, each having d~1 μm. This suggests a new permutation of wires in the braid roughly every l/N~15 μm. The force required to elastically bend a d=1 μm diameter, 15 μm section of copper wire through a full 90° is calculated to be in the 100 μN range. In some instances, this is an upper bound because the bending requirement depends on the detailed braid topology. The wires will likely only bend a few degrees, with forces in the μN range (energy of 50 pJ range for the order of magnitude displacement). In some implementations, the braiding method is able to exert this force in order to set each new permutation of braid, and is subsequently able to hold each permutation in place. In addition, the geometry of the braid and whether specific patterns optimize the electrical properties while reducing the assembly complexity may be considered.

Litz Bundles of Nanowires Made by Braiding Machines

The use of high-strength polymer cores allows nanowire braiding by conventional braiding machines commonly used to make litz bundles. For example, the breaking strength of a 10 μm diameter Kevlar wire is several kilograms, which is comparable to the strength of copper wires that are an order of magnitude larger in diameter. For smaller diameter nanowires, such as 1 μm or less, a miniaturized version of a braiding machine could still be used. However, its operation must respect the smaller breaking strength of such small nanowires.

Litz Bundles Made by Directed Assembly: Addressable Dielectrophoretic Platform

Figure 3:
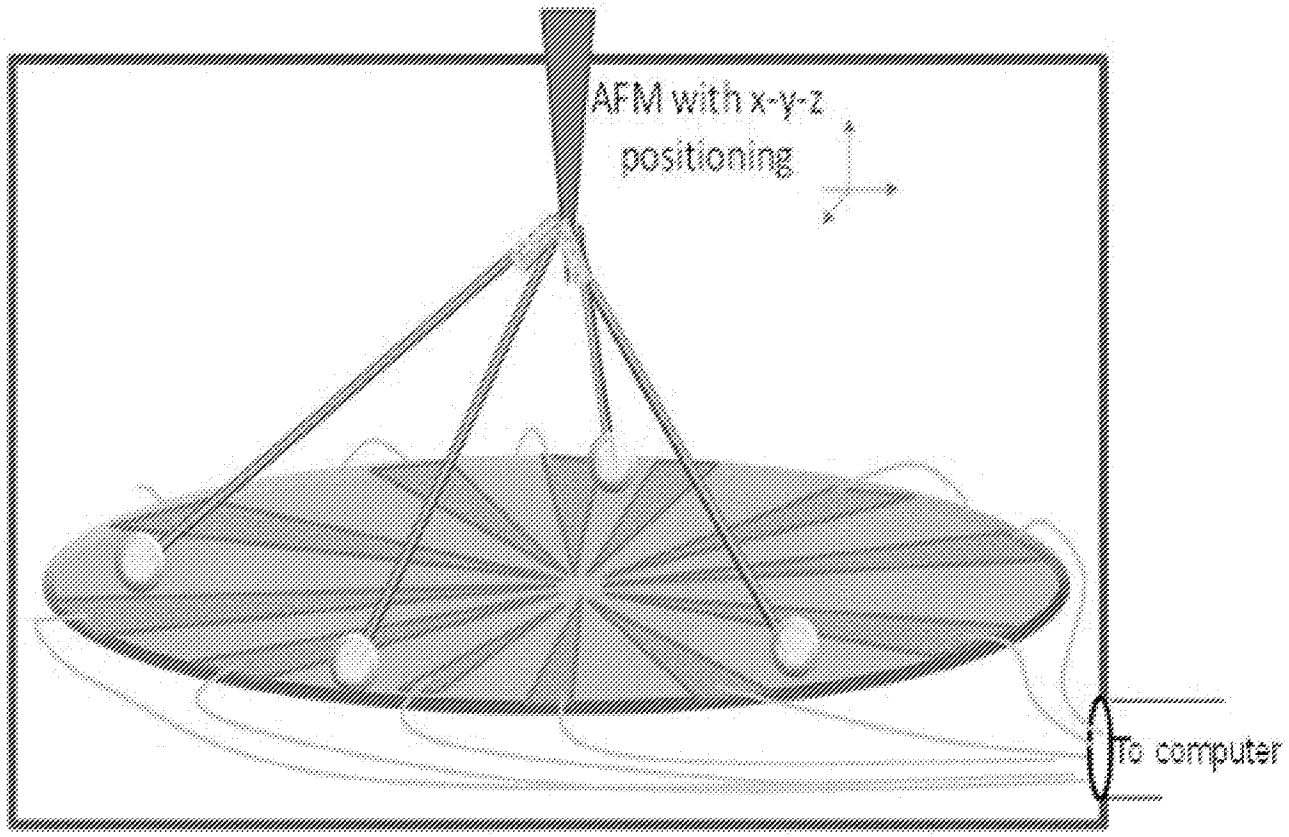
FIG. 3 illustrates how positive and negative dielectrophoresis using strategic electrode designs sweeps the beads through the braiding pattern, according to some embodiments.

Dielectrophoresis is a well-vetted technique for manipulation, sorting, and assembly of wires, cells, and micron scale components. For some embodiments described herein, a platform is used that manipulates dielectric beads into complex patterns using addressable electrodes that optimize dielectrophoretic forces. Such a platform can be used to manufacture wire braids. Dielectric beads (e.g., having magnetic cores) can be attached to the ends of individual wires. The wires may then be fixed together at one end. The ends attached to the beads can be manipulated using dielectrophoretic forces and woven into a braid using a computer-controlled interface. Such an approach is scalable from 10's of wires to 1000's of wires, and can be implemented at high speeds. For a square array with electrodes that are ~10 μm in diameter and pitch, with voltages on the order of 10V and example dielectric constants of $\varepsilon_{r,bead}\sim 2.5$ and $\varepsilon_{r,fluid}\sim 80$, the dielectrophoretic force can be on the order of μN, competing well with the elastic bending requirements for braiding. Such a system may be further optimized by selecting electrode geometries that map to the desired motion, for example as shown in FIG. 3, and using combinations of positive and negative dielectrophoresis. The force can be boosted by plating up the electrodes to high aspect ratios, using high dielectric constant materials, and/or increasing the voltages. Finally, by incorporating a ferrite bead core (e.g., non-conducting), magnetic controls can provide further flexibility in assembling the nanowires. Detailed mathematical modeling can be used to select the most appropriate parameters.

Example 1

Nanofibers were electrospun from a solution in N,N-dimethylacetamide containing 12 weight percent of polymeta-arylamide (trade name Nomex, made by DuPont) and 4 weight percent of lithium chloride. Electrospinning equipment made by IME Technologies, Geldrop, Netherlands was used. The nanofibers were collected on a rotating cylindrical drum so that the nanofibers formed a helix with nearly parallel strands around the cylinder.

The nanofibers were then covered with a strip of tape along the axis of the cylinder. A sharp knife was used to slit the tape along its middle, so that nanofibers whose length is equal to the circumference of the cylinder could be lifted off of the cylinder and transferred to a rectangular holder equal in length to the nanofibers. Clamps near the ends of the fibers were then attached and the pieces of tape removed. The clamps held the nanofibers suspended along the length of the substrate holder. Witness substrates of Nomex cloth and oxidized silicon wafer were also placed on the surface of the substrate holder below the suspended fibers.

The holder and its attached suspended fibers were then introduced into a cylindrical CVD chamber with 3 cm inner diameter and 30 cm length. The pressure in the chamber was reduced with an oil-based vacuum pump while it was heated to 200° C. in an atmosphere of flowing pure nitrogen gas (60 standard cubic centimeters per minute, sccm) at 5 Torr pressure from which water vapor and oxygen were removed to levels less than one part per billion by a purifier. The nanofibers and paper were held under these conditions for one hour to remove water vapor and oxygen.

Then gas flows of anhydrous ammonia (60 sccm) and pure hydrogen (60 sccm) were established through the reactor. A manganese precursor, bis(N,N'-di-tert-butylacetamidinato) manganese(II), dissolved at a concentration of 10 weight percent in dry tri-n-hexylamine, was evaporated by pumping the solution through a mass flow controller at a rate of 6 grams per hour into a coil of ¼ inch outer diameter stainless steel tubing in an oven heated to 160° C., along with pure nitrogen carrier gas flowing at 60 sccm. The total pressure in the deposition chamber was regulated to be 5 Torr and the temperature was set to 180° C. The combined flows of these gases passed over the nanowires, paper and oxidized silicon for 10 minutes, during which time they deposited a manganese nitride layer about 10 nm thick.

Next, a layer of iodine catalyst was deposited on the surface of the manganese nitride by exposing it to the ethyl iodide vapor from a liquid source at room temperature for 10 minutes. This adsorbed iodine speeds up the growth of the copper and also makes the surface of the copper smoother.

Then a copper precursor, (N,N'-di-sec-butylacetamidinato)copper(I), was dissolved in tri-n-hexylamine to the extent of 10 weight percent, and the solution was evaporated by pumping it at a rate of 6 cubic centimeters per hour into a coil of stainless steel tubing in an oven heated to 160° C., along with a flow of pure nitrogen carrier gas at 60 sccm. Pure hydrogen gas was also introduced into the deposition chamber at a rate of 60 sccm. The total pressure in the deposition chamber was regulated to be 5 Torr and the temperature was set to 200° C. The combined flows of these gases passed over the nanowires, paper and oxidized silicon for 30 minutes, during which time they deposited a smooth, conformal layer of copper about 50 nm thick. The sheet resistance of the metal layers was 0.5 ohms per square, measured on the paper and on the oxidized silicon samples.

Next, an insulating layer of aluminum-doped silica about 28 nm thick was deposited on the copper at 200° C. using four cycles of the catalytic atomic layer deposition method described in *Science* 298, 402 (2002).

Finally, the above steps of CVD of manganese nitride, iodine catalysis and CVD copper can be repeated to form an outer metallic layer bonded to the silica insulator.

Strong adhesion between all the layers was proven by noting that nothing could be removed by attaching tape to the witness paper and to the silicon sample and then removing it. The metal-insulator-metal layers remained attached to the paper and the silicon.

Comparative Example 1

Example 1 was repeated except that the manganese nitride step was omitted. The adhesion of the copper to the substrates was poor, as shown by the fact that the copper layer was removed by the tape from the paper and glass samples.

Hypothetical Example 2

Example 1 was repeated, except that the manganese nitride and copper deposition steps were replaced by chemical vapor deposition of aluminum metal according to the method described in U.S. Pat. No. 7,985,450 at a substrate temperature of 170° C.

Hypothetical Example 3

A conventional litz braiding machine may be used to braid the nanofibers into a litz bundle. For use with nanofibers, a smaller-scale version of the usual machines is preferable. By use of the high-strength polymer core, the nanofibers are strong enough to be braided by such machines. To see the operation of a full-size conventional braiding machine, see www.youtube.com/watch?v=pT9sskgZWiU.

Hypothetical Example 4

200 insulated nanofibers made according to the method of Examples 1 or 2 are braided into a litz bundle using the Addressable Dielectrophoretic Platform described above. An inductor with a high quality factor is produced.

Unless otherwise defined, used or characterized herein, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2%) can be understood as being within the scope of the description; likewise, if a particular shape is referenced, the shape is intended to include imperfect variations from ideal shapes, e.g., due to manufacturing tolerances.

Percentages or concentrations expressed herein can represent either by weight or by volume.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments. Spatially relative terms, such as "above," "below," "left," "right," "in front," "behind," and the like, may be used herein for ease of description to describe the relationship of one element to another element, as illustrated in the figures. It will be understood that the spatially relative terms, as well as the illustrated configurations, are intended to encompass different orientations of the apparatus in use or operation in addition to the orientations described herein and depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly. Further still, in this disclosure, when an element is referred to as being "on," "connected to," "coupled to," "in contact with," etc., another element, it may be directly on, connected to, coupled to, or in contact with the other element or intervening elements may be present unless otherwise specified.

The terminology used herein is for the purpose of describing particular embodiments and is not intended to be limiting of exemplary embodiments. As used herein, singular forms, such as "a" and "an," are intended to include the plural forms as well, unless the context indicates otherwise.

It will be appreciated that while a particular sequence of steps has been shown and described for purposes of explanation, the sequence may be varied in certain respects, or the steps may be combined, while still obtaining the desired configuration. Additionally, modifications to the disclosed embodiment and the invention as claimed are possible and within the scope of this disclosed invention.

We claim:

1. A litz braid comprising:

a plurality of wires bundled together so that each wire takes a turn near the center of the bundle, wherein at least one of the wires comprises a high-strength nanowire core;

a first electrically conductive metal layer that is bonded to an outer surface of the high-strength nanowire core; and an insulating layer that is bonded to an outer surface of the first electrically conductive metal layer; and wherein said at least one of the wires have a diameter of less than 10 micrometers.

2. The litz braid of claim 1, wherein said at least one of the wires further comprising a second electrically-conductive metal layer that is bonded to an outer surface of the insulating layer.

3. The litz braid of claim 1, wherein said at least one of the wires have a diameter of less than 2 micrometers.

4. The litz braid of claim 1, wherein said at least one of the wires have a diameter of less than 0.5 micrometers.

5. The litz braid of claim 1, wherein the nanowire core comprises a high-strength polymer.

6. The litz braid of claim 5, wherein the polymer comprises a polyarylamide.

7. The litz braid of claim 1, wherein the nanowire core comprises a carbon nanofiber.

8. The litz braid of claim 1, wherein the nanowire core comprises a silica fiber.

9. The litz braid of claim 1, wherein the metal comprises copper.

10. The litz braid of claim 1, wherein the metal comprises a copper manganese alloy.

11. The litz braid of claim 1, wherein the metal comprises aluminum.

12. The litz braid of claim 1, wherein the insulator comprises a metal oxide.

13. The litz braid of claim 1, wherein the insulator comprises a metal silicate.

14. The litz braid of claim 1, wherein the insulator comprises silica.

15. The litz braid of claim 2, wherein the first and second electrically conductive metal layers are the same.

16. An antenna comprising a litz braid according to claim 1.

17. An electronic circuit comprising a litz braid according to claim 1.

* * * * *